US007165282B2

(12) United States Patent
Watson

(10) Patent No.: US 7,165,282 B2
(45) Date of Patent: Jan. 23, 2007

(54) HINGED FOAM ASSEMBLY FOR MATTRESS MANUFACTURING

(75) Inventor: Timothy Franklin Watson, Dallas, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 0 days.

(21) Appl. No.: 10/761,011

(22) Filed: Jan. 20, 2004

(65) Prior Publication Data

US 2005/0081301 A1 Apr. 21, 2005

Related U.S. Application Data

(60) Provisional application No. 60/512,493, filed on Oct. 17, 2003.

(51) Int. Cl.
*A47C 17/00* (2006.01)

(52) U.S. Cl. ..... 5/739; 5/717

(58) Field of Classification Search ..... 5/717, 5/739, 340, 655.9, 953, 723, 718, 730
See application file for complete search history.

(56) References Cited

U.S. PATENT DOCUMENTS 3,732,586 A * 5/1973 Frey ..... 5/718
3,735,432 A * 5/1973 Kreten et al. ..... 5/680
4,429,427 A * 2/1984 Sklar ..... 5/654.1
5,557,813 A * 9/1996 Steed et al. ..... 5/739
5,701,623 A * 12/1997 May ..... 5/739
5,724,686 A * 3/1998 Neal ..... 5/717
5,937,458 A * 8/1999 DeRosa ..... 5/424
6,256,821 B1 * 7/2001 Boyd ..... 5/739
6,772,463 B1 * 8/2004 Gladney et al. ..... 5/739
2003/0000021 A1 1/2003 O'Connell et al.

FOREIGN PATENT DOCUMENTS

DE 10015489 A1 10/2001

* cited by examiner

*Primary Examiner*—Frederick L. Lagman
(74) *Attorney, Agent, or Firm*—Fish & Neave IP Group, Ropes & Gray LLP

(57) ABSTRACT

Edge rails for a mattress core are combined with an upholstery layer to provide a pre-assembled work piece that provides a perimeter about a mattress core. The edge rails, which may be foam, may be attached to the upholstery layer with hinges that permit each edge rail to rotate relative to the upholstery layer between an unassembled, flat position and an assembled, upright position. In the unassembled position, the work piece may present a relatively flat profile for more convenient bulk storage. In the assembled position, the edge rails are positioned to closely surround a mattress core of suitable size.

21 Claims, 2 Drawing Sheets

HINGED FOAM ASSEMBLY FOR MATTRESS MANUFACTURING

RELATED APPLICATIONS

This application claims the benefit of U.S. Provisional Patent Application Ser. No. 60/512,493, filed Oct. 17, 2003 and naming Timothy F. Watson as inventor, the contents of which are hereby incorporated by reference.

BACKGROUND OF THE INVENTION

1. Field of the Invention

The present invention relates to a hinged foam assembly for use in manufacturing mattresses.

2. Description of the Related Art

In conventional mattress manufacturing techniques, a reinforcing foam edge may be arranged a mattress core in order to improve properties of the sleeping surface.

While certain advantages of reinforced edges are acknowledged within the art, assembly of mattresses that employ these edges can be time consuming. Once a mattress core has been selected, an appropriate rail must be selected for each side, and then each rail must be properly aligned and secured to the core. In addition to requiring significant manual efforts, this technique introduces numerous opportunities for errors in selection of material and positioning of each rail. These opportunities for error are compounded when rails of different firmness are to be used on different edges of the mattress core.

There remains a need for an improved technique for assembling mattresses that have side rails.

SUMMARY

Edge rails for a mattress core are combined with an upholstery layer to provide a pre-assembled work piece that provides a perimeter about a mattress core. The edge rails, which may be foam, may be attached to the upholstery layer with hinges that permit each edge rail to rotate relative to the upholstery layer between an unassembled, flat position and an assembled, upright position. In the unassembled position, the work piece may present a relatively flat profile for more convenient bulk storage. In the assembled position, the edge rails are positioned to closely surround a mattress core of suitable size.

In use, the work piece may be placed on a work surface in the unassembled position. A mattress core may then be placed on the work piece, and each edge rail may be hinged into position as a rail for the mattress core. The edge rails may then be secured to each other and/or the mattress core to provide an assembled mattress that includes a reinforced edge.

In one aspect, there is disclosed herein an assembly including an upholstery layer for use with a mattress, a plurality of edge rails shaped and sized for use as edge rails of the mattress, and a plurality of hinges connecting each one of the plurality of edge rails to the upholstery layer such that each one of the plurality of edge rails can independently move between an unassembled position and an assembled position.

The mattress may be at least one of a king sized mattress, a queen sized mattress, or a twin sized mattress. The upholstery layer may include a foam layer. The upholstery layer and at least one of the edge rails may be formed from a single piece of foam, the hinge connecting the at least one of the edge rails and the upholstery layer including a slit in the single piece of foam. The plurality of edge rails may be foam edges including at least one of a viscoelastic foam or a latex foam rubber.

The plurality of edge rails may include at least two side edges for an assembled mattress. The plurality of edge rails may include at least a head edge and a foot edge for an assembled mattress. The assembly may be affixed to a mattress core using tape. The tape may include two-sided tape. The assembly may be affixed to itself with each of the plurality of edge rails in the assembled position using at least one of tape, staples, or hog rings.

The upholstery layer may include at least one of quilting, batting, or a moisture barrier. The upholstery layer may extend over one surface of each of the edge rails to provide an upholstery layer for one or more sides of an assembled mattress. The upholstery layer may be a top upholstery layer or a bottom upholstery layer of an assembled mattress. A mattress core may be enclosed by the assembly. The mattress core may include foam, spring coils, and/or pocket coils. The hinges may include tape. The upholstery layer may include one or more alignment marks for positioning a mattress core relative to the upholstery layer during an assembly process.

In another aspect, there is disclosed herein a method of assembling a mattress comprising: providing an assembly including an upholstery layer and a plurality of edge rails connected to the upholstery layer by hinges; positioning the upholstery layer adjacent to a surface of a mattress core; rotating each one of the plurality of edge rails to rest adjacent to one of the plurality of a plurality of edges of the mattress core; and securing the plurality of edge rails to the mattress core.

The step of positioning the upholstery layer adjacent to the surface of the mattress core may include placing the mattress core on a work surface and positioning the upholstery layer on top of the mattress core, or placing the upholstery layer on a work surface and positioning the mattress core on top of the upholstery layer. The step of securing the plurality of edge rails to the mattress core may include gluing the edge rails to the mattress core, or using two-sided tape, a first side of the two-sided tape adhering to one of the plurality of edge rails and a second side of the two-sided tape adhering to the mattress core.

The method may include securing at least one of the plurality of edge rails to at least one other one of the plurality of edge rails.

In another aspect, there is disclosed herein an assembly for use in construction of a mattress including an upholstery layer for use with a mattress; a plurality of edge rails shaped and sized for use as edges of the mattress; and a plurality hinge means for movably and independently positioning each of the plurality of edge rails adjacent to the upholstery layer.

BRIEF DESCRIPTION OF THE DRAWINGS

The present disclosure may be better understood and its numerous features and advantages made apparent to those skilled in the art by referencing the accompanying drawings wherein.

DETAILED DESCRIPTION

Described herein is a mattress cover with hinged, foam edge rails. However, it will be appreciated that the principles of the system described herein may be adapted to a wide range of applications where a cushioned surface is constructed with edges of foam or other material. For example, the principles of this disclosure may be applied to couches or padded seats with reinforced foam edges, or to mattresses having a row of spring coils attached to the outer perimeter of a foam mattress core. These and other applications not specifically described below are intended to fall within the scope of the systems and methods described herein.

Figure 1:
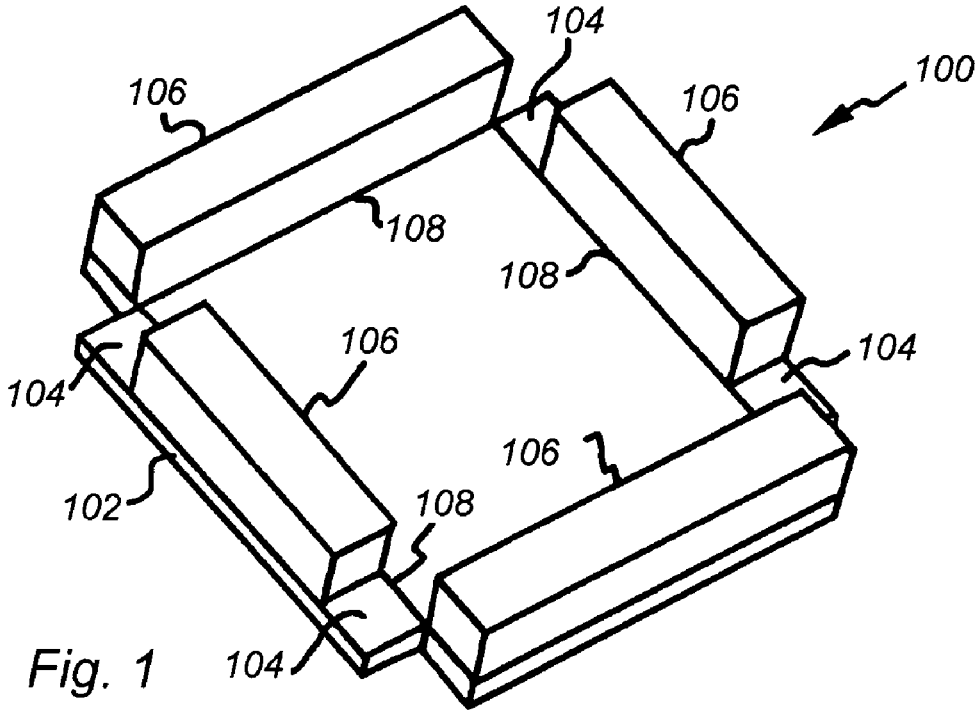
FIG. 1 shows a perspective view of an assembly for a mattress cover with edge rails in an unassembled position.

FIG. 1 shows a perspective view of an assembly for a mattress cover with edge rails in an unassembled position. The assembly 100 includes an upholstery layer 102 with one or more flaps 104, one or more edge rails 106, and one or more hinges 108.

The assembly 100 may be for use with, for example, a queen size mattress, a king size mattress, a twin mattress, or any other mattress of conventional or unconventional dimensions. The assembly 100 may be shaped and sized to fit over a mattress core (not shown) of any general construction. The mattress core may be, for example, a foam core, an open spring core, or a pocket spring core, or any combination of these constructed to provide a suitable sleeping surface. A mattress using the assembly 100 and a mattress core may be designed for use in varying orientations, or the mattress may be a no-flip mattress that is designed for use in one or two orientations with a single upper surface.

The upholstery layer 102 may include one or more upholstery layers useful in mattress construction. This may include, for example, batting, quilting, padding, or other materials used to enhance comfort, strength, thickness, or some other desirable property of an assembled mattress. The upholstery layer 102 may include reinforcing materials such as plastic sheets or fibers. It may also include functional layers such as a moisture barrier, or exterior quilting and any associated stitching or labeling. More generally, combinations of these layers corresponding to the layers desired for an assembled mattress may be included within the upholstery layer 102.

Figure 2:
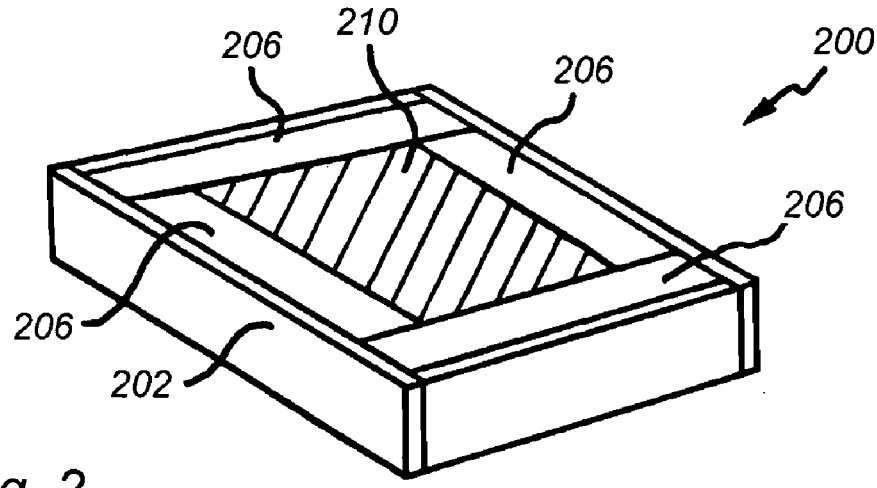
FIG. 2 shows a perspective view of an assembly for a mattress cover with edge rails in an assembled position.

The upholstery layer 102 may include one or more flaps 104 which overlap the ends of adjacent edge rails 106 when the edge rails 106 are in an assembled position (see FIG. 2). This configuration permits a convenient point of attachment for the edge rails using, for example, glue, two-sided adhesive tape, or one-sided tape around the outside of each corner. The edges may also be secured with staples, hog rings, ultrasonic welds, or any other attachment means that is suitable strong to support the assembled mattress when in use. It will be appreciated that, while the flaps 104 are shown on only two of the sides with the edge rail 106 centered between the flaps, other arrangements are possible, such as one flap 104 on each edge extending from a single side of each edge rail 106. In this arrangement, each edge rail 106 would extend to one of the corners of the assembled mattress, with a flap on an opposing end for attachment to an adjacent edge rail 106 that extends to the adjacent corner.

The edge rails 106 may be foam edges fashioned from, for example, a viscoelastic foam or a latex foam rubber. They may be of any desired firmness according to the intended properties of the assembled mattress, and may be firmer than the mattress core, the same firmness as the mattress core, or less firm than the mattress core, or some combination of these, such as firmer side edge rails 106 and less firm head and foot edge rails 106. The edge rails 106 may be, for example, the depth of a mattress, and two to six inches wide in the plane of the mattress surface.

While foam edges are useful in mattress construction, the edge rails 106 may include other materials, such as a row of spring coils or pocket coils, reinforcing edge materials such as border wires or plastic, adjustable air bladders, or any other materials useful in constructing mattress edges, and combinations of these. It will also be appreciated that, while four edge rails 106 are shown, the assembly 100 may also be constructed with one, two, or three edge rails 106 according to the desired construction of the assembled mattress. Other numbers of edge rails 106 may also be used where, for example, the mattress has an unusual geometric shape (e.g., an octagonal mattress) or multiple sections of different materials are to be used on one of the edge rails 106.

The hinges 108 may run along each side of the upholstery layer 102 where each edge rail 106 is to be folded around a mattress core. Any number of constructions may be used for the hinges 108. Two examples are provided below with reference to FIGS. 4 and 5. However, it will be appreciated that other hinge means or techniques may be employed provided they accommodate movement of the edge rails 106 between unassembled and assembled positions, and that they are sufficiently strong, or reinforceable in a manner to become sufficiently strong, to support the assembled mattress during use and wear.

In use, the assembly 100 may be placed on a work surface in the unassembled position. A mattress core (not shown) may then be placed on the assembly 100, and each edge rail 106 may be hinged into position as a rail for the mattress core. The edge rails 106 may then be secured to each other and/or the mattress core to provide an assembled mattress that includes a reinforced edge. Prior to use, the assembly 100 may be left in its unassembled state, which may have a lower profile than the assembled state that is more suitable for stacking, storage, and transportation.

FIG. 2 shows a perspective view of an assembly for a mattress cover with edge rails in an assembled position. The assembly 200 may include an upholstery layer 202 and edge rails 206 surrounding a mattress core 210. The edge rails 206 may be, for example, any of the edge rails 106 discussed above with reference to FIG. 1. The upholstery layer 202 enclosing the edge rails 206 may be, for example, the upholstery layers 102 described above with reference to FIG. 1. It should further be appreciated that, while the upholstery layer 202 may be conveniently extended to serve as an upholstery for the sides of an assembled mattress, in certain constructions the upholstery layer 202 may not extend around the exterior edge as depicted in FIG. 2. For example, where one or more of the hinges (not shown) are formed of a tape joint between the edge rail 206 and the upholstery layer 202, the upholstery layer 202 may not extend around the perimeter of the mattress. Such a hinge is depicted, for example, in FIG. 4 below.

The mattress core 210 may be of any conventional or unconventional construction suitable for use in a mattress. Although coils are commonly used in mattress cores, it will be appreciated that any material or materials may be used including open coils, pocket coils, a monolithic or composite foam (such as viscoelastic foam), foams of varying densities and firmness, fluids or gasses in one or more bladders, or any combination of these. A mattress using the assembly 200 and a mattress core 210 may be designed for use in varying orientations, or the mattress may be a no-flip mattress that is designed for use in one or two orientations with a single upper surface.

The assembly 200 may be attached to the mattress core 210 and to itself using, for example, glue, tape, two-sided tape, adhesive patches such as Duon, staples, hog rings, ultrasonic welds, or any other technique that will maintain the assembled mattress in its assembled state during use and wear. As another example, an additional upholstery layer (not shown) may extend around the four sides of the perimeter of the assembly 200 to hold the edge rails securely about the mattress core 210.

Thus, it will be appreciated that in one respect, there is disclosed herein a method for assembling a mattress. The method may include providing the assembly 100, 200, and positioning the mattress core 210 adjacent to the assembly 100, with either the mattress core 210 or the assembly 100, 200 placed on a work surface, and the other piece placed on top. Alignment marks may be provided on the assembly 100, 200 to assist in properly aligning the mattress core 210 before hinging the edge rails 206 into their assembled position. The edge rails 206 may then be rotated on their hinges into the assembled position, and the edge rails 206 secured in place using any of the techniques described above.

Figure 3:
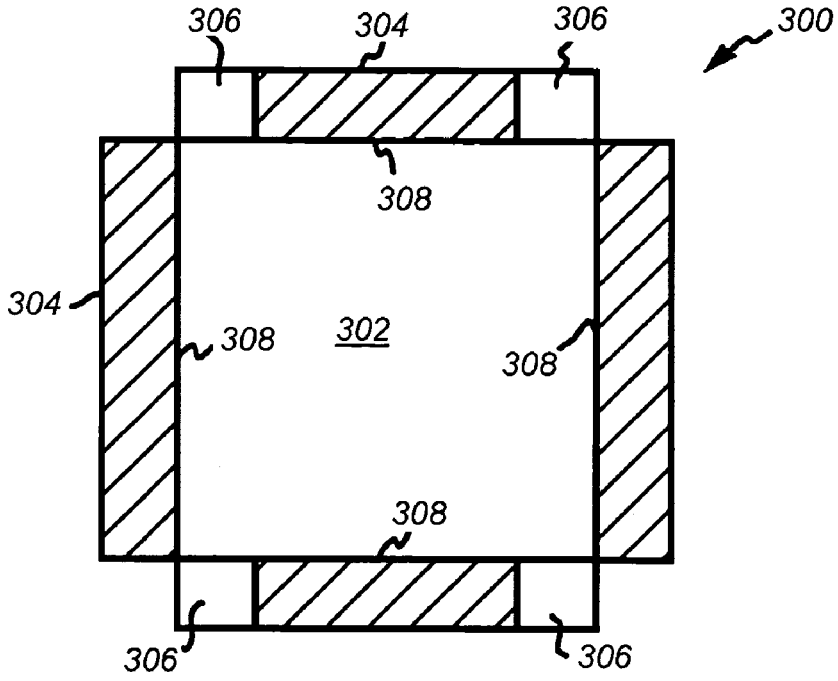
FIG. 3 shows a plan view of an assembly for a mattress cover with edge rails.

FIG. 3 shows a plan view of an assembly for a mattress cover with edge rails. The assembly 300 may include an upholstery layer 302, edge rails 304, flaps 306, and hinges 308, substantially as described above with reference to FIGS. 1 and 2.

Figure 4:
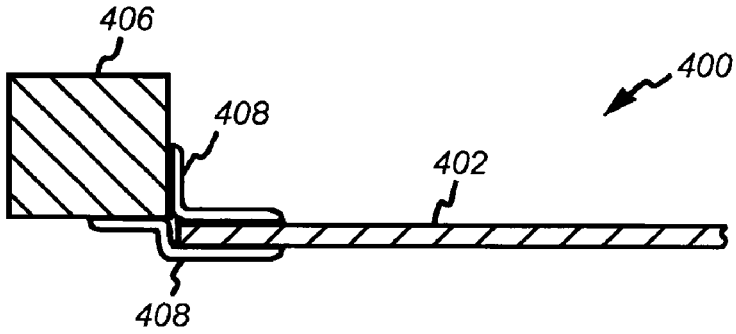
FIGS. 4–5 show hinges that may be used with the assembly.

FIG. 4 shows a hinge that may be used with the assembly. The hinge 400 may connect an upholstery layer 402 to an edge rail 406 using, for example, a tape 408. The upholstery layer 402 and the edge rail 406 may be any of the upholstery layers and edge rails described above.

The tape 408 may be any tape of sufficient tear strength to support the hinge 400, and having sufficient adhesive strength to adhere to the edge rail 406 and the upholstery layer 402 during assembly and use of a mattress. It will be appreciated that if the tape bond is sufficiently strong, then the tape 408 may only be required on one side of the hinge 400, i.e., on the inside or on the outside. It will also be appreciated that the tape hinge 400 need not extend along an entire edge rail, as depicted in, for example, the plan view of FIG. 3. In certain embodiments, the hinge 400 may be formed by a number of separate joints along the edge rail 406. In one embodiment, a single piece of tape may extend from one surface of the upholstery layer 402 completely around the edge rail 406 to the other, opposing surface of the upholstery layer 402. This may be particularly useful where the tape-to-edge rail bond is weak.

Figure 5:
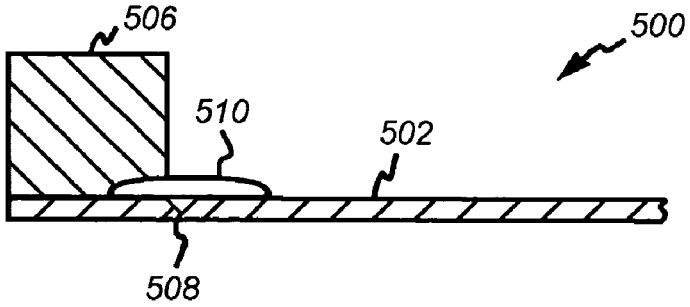

FIG. 5 shows a hinge that may be used with the assembly. The hinge 500 may join an upholstery layer 508 to an edge rail 506. In this embodiment, the upholstery layer 508 is a foam upholstery layer, and includes a notch 508 to prevent compression of foam around the hinge 500 when the edge rail 506 is rotated. This notch 508 may also be employed, for example, when the upholstery layer 502 and the edge rail 506 are formed of a single, integral piece of foam. A tape 510 may be included to strengthen and reinforce the hinge 500. Although depicted in a certain location within the hinge 500, it will be appreciated that the tape 510 may be provided at one or more of a number of locations, such as along the outside of the hinge 500 (the bottom surface, as depicted), or along the inside of the hinge 500 (i.e., along the right side of the edge rail 506 as depicted, and then bending perpendicular to join the surface of the upholstery layer 502). These and other possible arrangements employing tapes, glues and other attachment techniques are intended to fall within the scope of the term "hinge" as used herein.

While particular embodiments of the present invention have been shown and described, it will be apparent to those skilled in the art that changes and modifications may be made without departing from the scope of the invention, and therefore, the following claims are to be interpreted in the broadest sense allowable by law.

What is claimed is:

1. An assembly comprising:

an upholstery layer for use with a mattress;

a plurality of edge rails shaped and sized for use as edge rails of the mattress; and a plurality of hinges connecting each one of the plurality of edge rails to the upholstery layer such that each one of the plurality of edge rails can independently move between an unassembled position and an assembled position;

wherein the hinges include tape.

2. The assembly of claim 1 wherein the mattress is at least one of a king sized mattress, a queen sized mattress, or a twin sized mattress.

3. The assembly of claim 1 wherein the upholstery layer comprises a foam layer.

4. The assembly of claim 3 wherein the upholstery layer and at least one of the edge rails are formed from a single piece of foam, the hinge connecting the at least one of the edge rails and the upholstery layer including a slit in the single piece of foam.

5. The assembly of claim 1 wherein the plurality of edge rails are foam edges including at least one of a viscoelastic foam or a latex foam rubber.

6. The assembly of claim 1 wherein the plurality of edge rails include at least two side edges for an assembled mattress.

7. The assembly of claim 1 wherein the plurality of edge rails include at least a head edge and a foot edge for an assembled mattress.

8. The assembly of claim 1 wherein the assembly is affixed to a mattress core using tape.

9. The assembly of claim 8 wherein the tape includes two-sided tape.

10. The assembly of claim 1 wherein the assembly is affixed to itself with each of the plurality of edge rails in the assembled position using at least one of tape, staples, or hog rings.

11. The assembly of claim 1 wherein the upholstery layer includes at least one of quilting, batting, or a moisture barrier.

12. The assembly of claim 1 wherein the upholstery layer extends over one surface of each of the edge rails to provide an upholstery layer for one or more sides of an assembled mattress.

13. The assembly of claim 1 wherein the upholstery layer is at least one of a top upholstery layer of the mattress or a bottom upholstery layer of an assembled mattress.

14. The assembly of claim 1 further comprising a mattress core enclosed by the assembly, the mattress core including at least one of foam, spring coils, or pocket coils.

15. A method of assembling a mattress comprising:

providing an assembly including an upholstery layer and a plurality of edge rails connected to the upholstery layer by hinges;

positioning the upholstery layer adjacent to a surface of a mattress core;

rotating each one of the plurality of edge rails to rest adjacent to one of the plurality of a plurality of edges of the mattress core; and securing the plurality of edge rails to the mattress core.

16. The method of claim 15 wherein positioning the upholstery layer adjacent to the surface of the mattress core comprises placing the mattress core on a work surface and positioning the upholstery layer on top of the mattress core.

17. The method of claim 15 wherein positioning the upholstery layer adjacent to the surface of the mattress core comprises placing the upholstery layer on a work surface and positioning the mattress core on top of the upholstery layer.

18. The method of claim 15 wherein securing the plurality of edge rails to the mattress core further comprises gluing the edge rails to the mattress core.

19. The method of claim 15 wherein securing the plurality of edge rails to the mattress core further comprises using two-sided tape, a first side of the two-sided tape adhering to one of the plurality of edge rails and a second side of the two-sided tape adhering to the mattress core.

20. The method of claim 15 further comprising securing at least one of the plurality of edge rails to at least one other one of the plurality of edge rails.

21. An assembly for use in construction of a mattress comprising:

an upholstery layer for use with a mattress;

a plurality of edge rails shaped and sized for use as edges of the mattress; and a plurality of hinges for movably and independently positioning each of the plurality of edge rails adjacent to the upholstery layer;

wherein the hinges include tape.

* * * * *